US008776808B2

(12) United States Patent
Fountain et al.

(10) Patent No.: US 8,776,808 B2
(45) Date of Patent: Jul. 15, 2014

(54) ROTARY DRUM FILTER FOR A DISHWASHING MACHINE

(75) Inventors: Jordan Robert Fountain, Saint Joseph, MI (US); Dennis L. Kehl, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1190 days.

(21) Appl. No.: 12/561,375

(22) Filed: Sep. 17, 2009

(65) Prior Publication Data

US 2011/0061682 A1 Mar. 17, 2011

(51) Int. Cl.
*A47L 15/42* (2006.01)

(52) U.S. Cl.
USPC ..... 134/104.1; 134/56 D; 134/104.4

(58) Field of Classification Search
CPC ..... A47L 15/4208; A47L 15/4202
USPC ..... 134/104.1
See application file for complete search history.

(56) References Cited

U.S. PATENT DOCUMENTS

| | | | | |
|---|---|---|---|---|
| 5,030,357 | A | 7/1991 | Lowe | |
| 5,133,863 | A | 7/1992 | Zander | |
| 5,470,472 | A | 11/1995 | Baird et al. | |
| 5,618,424 | A | 4/1997 | Nagaoka | |
| 5,711,325 | A * | 1/1998 | Kloss et al. | 134/104.1 |
| 5,865,997 | A | 2/1999 | Isaacs | |
| 6,666,976 | B2 | 12/2003 | Benenson, Jr. et al. | |
| 6,800,197 | B1 | 10/2004 | Kosola et al. | |
| 7,208,080 | B2 | 4/2007 | Batten et al. | |
| 7,319,841 | B2 | 1/2008 | Bateman, III et al. | |
| 7,326,338 | B2 | 2/2008 | Batten et al. | |
| 7,497,222 | B2 * | 3/2009 | Edwards et al. | 134/111 |
| 8,215,322 | B2 * | 7/2012 | Fountain et al. | 134/104.4 |

FOREIGN PATENT DOCUMENTS

EP 1386575 A1 * 2/2004 ..... A47L 15/42

* cited by examiner

*Primary Examiner* — Michael Barr
*Assistant Examiner* — Jason Riggleman

(57) ABSTRACT

A dishwashing machine includes a sump chamber, a porous sheet enclosing a hollow interior, and a scraper in contact with the porous sheet. A portion of the sheet extends into the sump chamber. The sheet is operable to rotate about an imaginary axis.

19 Claims, 6 Drawing Sheets

ROTARY DRUM FILTER FOR A DISHWASHING MACHINE

TECHNICAL FIELD

The present disclosure relates generally to a dishwashing machine and more particularly to a filter for a dishwashing machine.

BACKGROUND

A dishwashing machine is a domestic appliance into which dishes and other cooking and eating wares (e.g., plates, bowls, glasses, flatware, pots, pans, bowls, etcetera) are placed to be washed. A dishwashing machine filters soil particles from the wash fluid.

SUMMARY

According to one aspect, a dishwashing machine includes a spray arm, a sump chamber positioned below the spray arm for collecting fluid and soil particles, and a porous sheet enclosing a hollow interior. The porous sheet is operable to rotate about an imaginary axis, and a portion of the porous sheet extends into the sump chamber. A scraper is in contact with the porous sheet. In some embodiments, the dishwashing machine may include an outlet positioned in a wall of the sump chamber and within the hollow interior, and a wash pump coupled to the outlet. The wash pump may be operable to move fluid through the porous sheet into the hollow interior. Additionally, in some embodiments, the porous sheet may include an outer surface and an inner surface. Soil particles may accumulate on the outer surface of the porous sheet when fluid moves through the porous sheet into the hollow interior.

In some embodiments, the scraper may include a first scraper blade in contact with the outer surface of the porous sheet. The first scraper blade is operable to remove accumulated soil particles from the outer surface of the porous sheet. The scraper may further include a second scraper blade in contact with the inner surface of the porous sheet.

In some embodiments, the dishwashing machine may include a soil chamber positioned adjacent to the sump chamber. The first scraper blade may be positioned relative to the soil chamber such that the soil particles removed by the first scraper blade accumulate in the soil chamber. Additionally, in some embodiments, the dishwashing machine may further include a drain pump coupled to the soil chamber and the sump chamber. The drain pump may be operable to remove accumulated soil particles from the soil chamber.

In some embodiments, the porous sheet may include a sheet selected from the group consisting of perforated metal, chemically etched metal, woven wire mesh, and wedge wire. Additionally, in some embodiments, the porous sheet may be a sheet of perforated metal having a number of holes and each hole has a diameter of 0.150 to 0.300 millimeters. In some embodiments, the portion of the porous sheet that extends into the sump chamber may be less than or equal to approximately sixty percent of the porous sheet.

According to another aspect, the dishwashing machine includes a washing chamber having a bottom surface, a sump chamber positioned in the bottom surface of the washing chamber, a cylindrical drum operable to rotate about an imaginary axis parallel to the bottom surface of the washing chamber. The drum has a first end, a second end, and a portion extending into the sump chamber. A filter sheet extends from the first end of the drum to the second end of the drum and encloses a hollow interior. The filter sheet has an outer porous surface and an inner porous surface. A first scraper blade is in contact with the outer porous surface, and a second scraper blade is in contact with the inner porous surface.

In some embodiments, the first scraper blade may extend from the first end of the drum to the second end of the drum. Additionally, in some embodiments, the dishwashing machine may include a motor positioned relative to the sump chamber. The motor has a shaft operable to rotate about the imaginary axis. The first end of the drum may be coupled to the shaft such that the motor is operable to rotate the drum about the imaginary axis. In some embodiments, the dishwashing machine may further include a beam positioned in the hollow interior. The second scraper blade may be coupled to a portion of the beam.

According to another aspect, a method of operating a dishwashing machine includes the steps of expelling wash fluid from a spray arm onto dishware positioned in a washing chamber, removing soil particles located on the dishware with wash fluid, collecting wash fluid and soil particles in a sump chamber, advancing a porous sheet through the sump chamber such that soil particles accumulate on an outer surface of the porous sheet and wash fluid passes through the porous sheet, and scraping the outer surface of the porous sheet with a scraper to remove the accumulated soil particles from the outer surface during the advancement of the porous sheet through the sump chamber. In some embodiments, the method may further include the step of scraping an inner surface of the porous sheet to remove a film formed on the inner surface during the advancement of the porous sheet through the sump chamber.

In some embodiments, the scraping step may include moving the accumulated soil particles to a soil chamber positioned adjacent to the sump chamber. Additionally, in some embodiments, the advancing step may include rotating the porous sheet about an imaginary axis. In some embodiments, the method may include draining the wash fluid and soil particles from the sump chamber, and removing the accumulate soil particles from the soil chamber. Additionally, in some embodiments, the method may further include moving the wash fluid that passes through the porous sheet to the spray arm.

BRIEF DESCRIPTION OF THE DRAWINGS

The detailed description particularly refers to the following figures, in which.

DETAILED DESCRIPTION OF THE DRAWINGS

Figure 1:
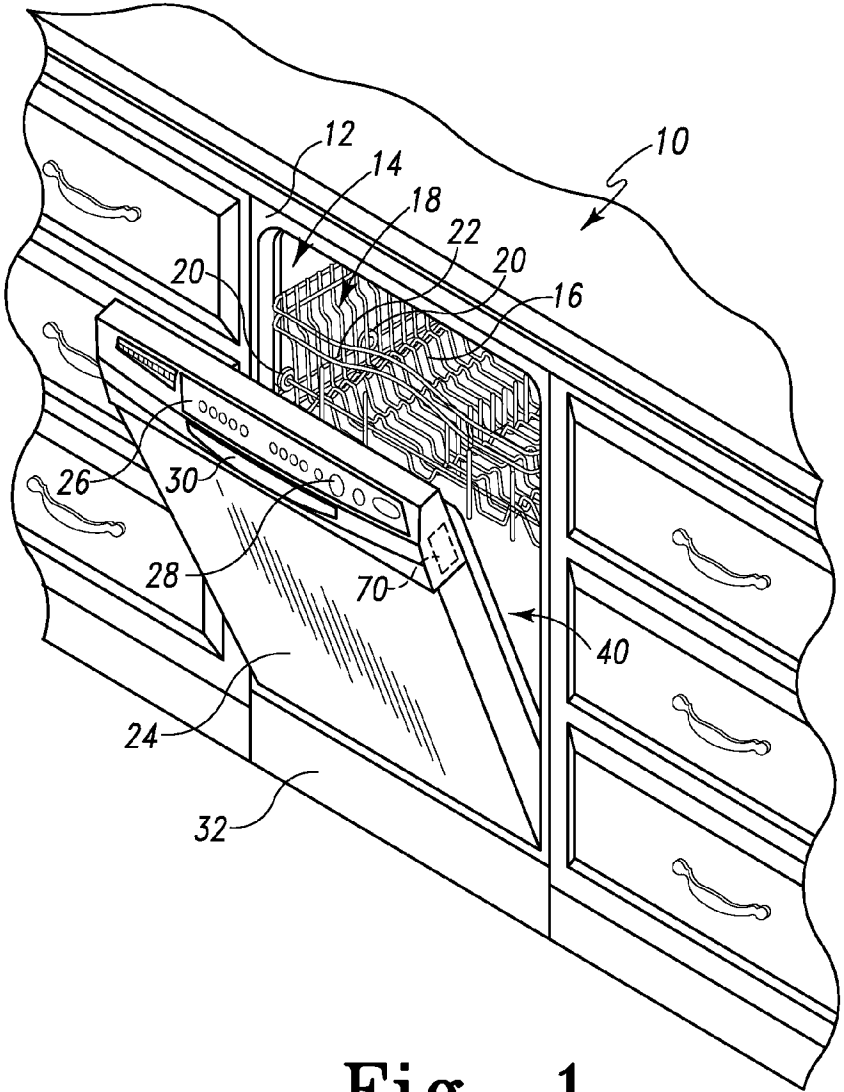
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a dishwashing machine 10 (hereinafter dishwasher 10) is shown. The dishwasher 10 has a tub 12 that defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish racks 16 and the tub 12. The roller assemblies 18 allow the dish racks 16 to extend from and retract into the tub 12, which facilitates the loading and unloading of the dish racks 16. The roller assemblies 18 include a number of rollers 20 that move along a corresponding support rail 22.

A door 24 is hinged to the lower front edge of the tub 12. The door 24 permits user access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, which are used to control the operation of the dishwasher 10. A handle 30 is also included in the control panel 26. The user may use the handle 30 to unlatch the door 24 such that the door 24 may be opened.

Figure 2:
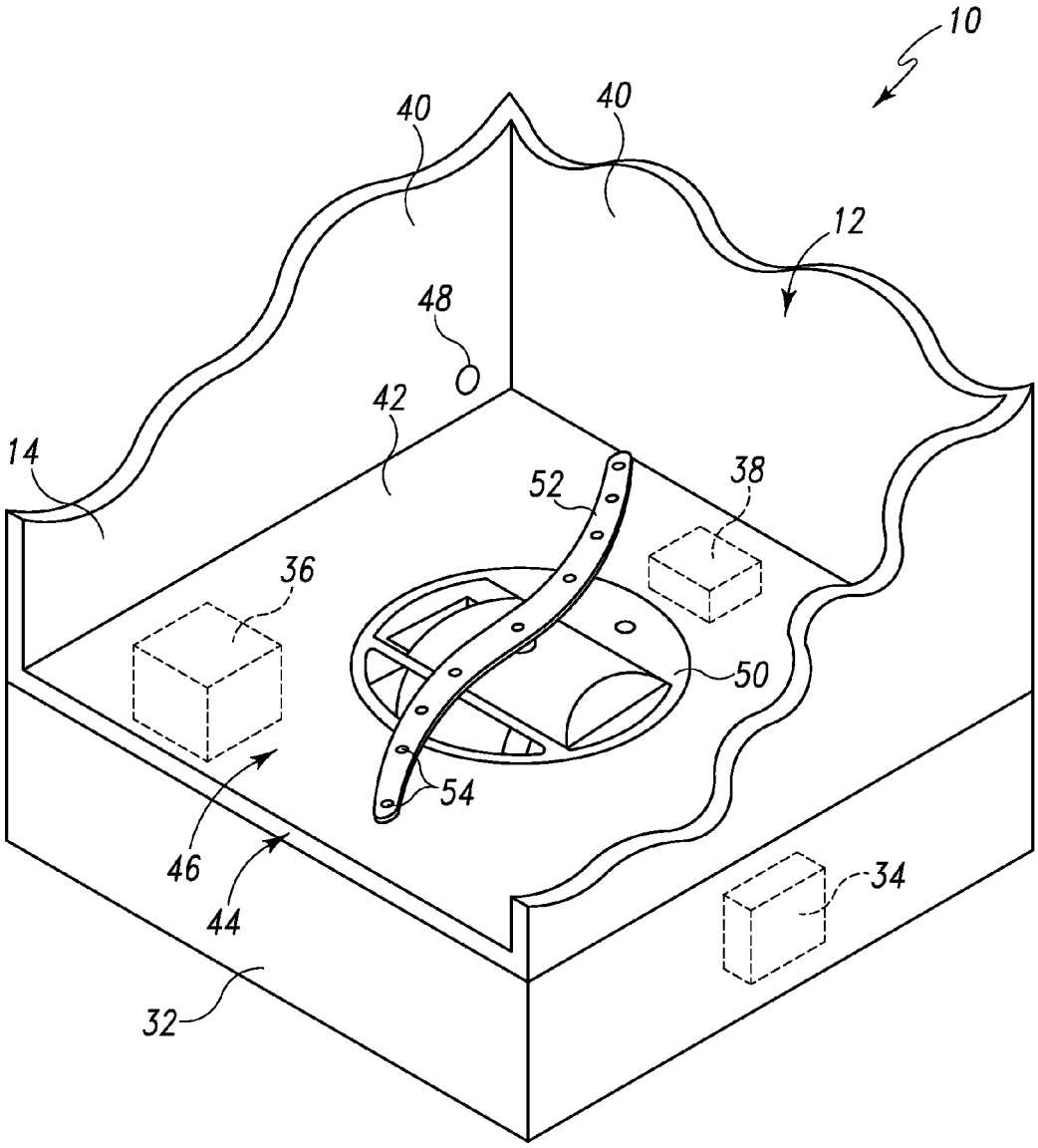
FIG. 2 is a fragmentary perspective view of the tub of the dishwashing machine of FIG. 1.
Figure 3:
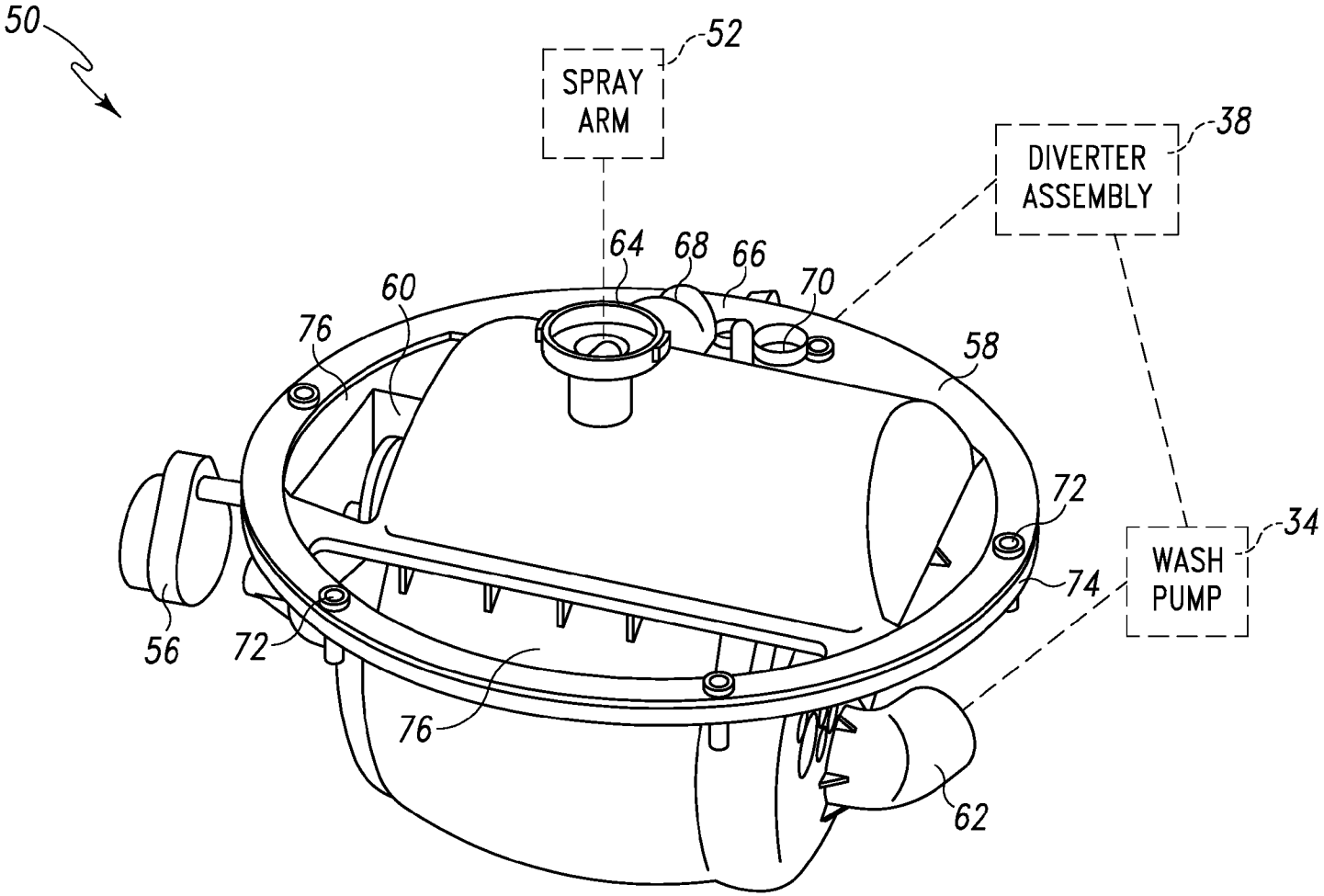
FIG. 3 is a perspective view of an embodiment of a rotary drum filter and a sump chamber.

A machine compartment 32 is located below the tub 12. The machine compartment 32 is sealed from the tub 12. In other words, unlike the tub 12, which is filled with fluid and exposed to spray during the wash cycle, the machine compartment 32 does not fill with fluid and is not exposed to spray during the operation of the dishwasher 10. Referring now to FIG. 2, the machine compartment 32 houses a wash pump 34, a drain pump 36, a diverter assembly 38, and other components such as the dishwasher's motor(s) and valve(s), along with the associated wiring and plumbing.

FIG. 2 shows the tub 12 of the dishwasher 10 in greater detail. The tub 12 includes a number of sidewalls 40 extending upwardly from a bottom wall 42 to define the washing chamber 14. The open front side 44 of the tub 12 defines an access opening 46 of the dishwasher 10. The access opening 46 provides the user with access to the dish racks 16 positioned in the washing chamber 14 when the door 24 is open. When closed, the door 24 seals the access opening 46, which prevents the user from accessing the dish racks 16. The door 24 also prevents fluid from escaping through the access opening 46 of the dishwasher 10 during a wash cycle.

The bottom wall 42 of the tub 12 has a recirculation sump 50 positioned therein. At the start of a wash cycle, fluid enters the tub 12 through a hole 48 defined in the sidewall 40. The sloped configuration of the bottom wall 42 directs fluid into the recirculation sump 50. The wash pump 34 removes such water and/or wash chemistry from the recirculation sump 50 after the sump 50 is partially filled with fluid.

The wash pump 34 is connected to a rotating spray arm 52 that sprays water and/or wash chemistry onto the dish racks 16 (and hence any wares positioned thereon). Additional rotating spray arms (not shown) are positioned above the spray arm 52. It should also be appreciated that the dishwashing machine 10 may include other spray arms positioned at various locations in the tub 12. As shown in FIG. 2, the spray arm 52 has a number of nozzles 54. Fluid passes from the wash pump 34 into the spray arm 52 and then exits the spray arm 52 through the nozzles 54. In the illustrative embodiment described herein, the nozzles 54 are embodied simply as holes formed in the spray arm 52. However, it is within the scope of the disclosure for the nozzles 54 to include inserts such as tips or other similar structures that are placed into the holes formed in the spray arm 52. Such inserts may be useful in configuring the spray direction or spray pattern of the fluid expelled from the spray arm 52.

After wash fluid contacts the dish racks 16 and any wares positioned in the washing chamber 14, a mixture of fluid and soil falls onto the bottom wall 42 and collects in the recirculation sump 50. As will be discussed in detail below, wash fluid is filtered out of the mixture in the recirculation sump 50 and re-circulated onto the dish racks 16 by the wash pump 34. At the conclusion of the wash cycle, the drain pump 36 removes both wash fluid and soil particles from the recirculation sump 50 and the tub 12.

Referring now to FIGS. 3-6, the recirculation sump 50 are shown removed from the dishwashing machine 10. The recirculation sump 50 includes a motor 56, a cover 58, a sump chamber 60, and an outlet tube 62 that fluidly connects the sump chamber 60 to the wash pump 34. A spray arm base 64 is coupled to an upper surface 66 of the cover 58 and is configured to receive the spray arm 52. The base 64 includes a conduit 68 that couples the spray arm 52 to one of three outlets 70 (see FIG. 4). The outlets 70 are included in the diverter assembly 38 that selectively delivers wash fluid from the wash pump 34 to the spray arm 52 or any of the other spray arms located in the washing chamber 14.

A number of fasteners 72 secure the cover 58 to a rim 74 of the sump chamber 60. In the illustrative embodiment, each fastener 72 is a threaded screw. It should be appreciated that the fastener 72 may be a clip, a pin, or any other type of fastener suitable for securing the cover 58 to the rim 74. Fluid from the tub 12 passes into the sump chamber 60 through a number of openings 76 formed in the cover 58.

Figure 4:
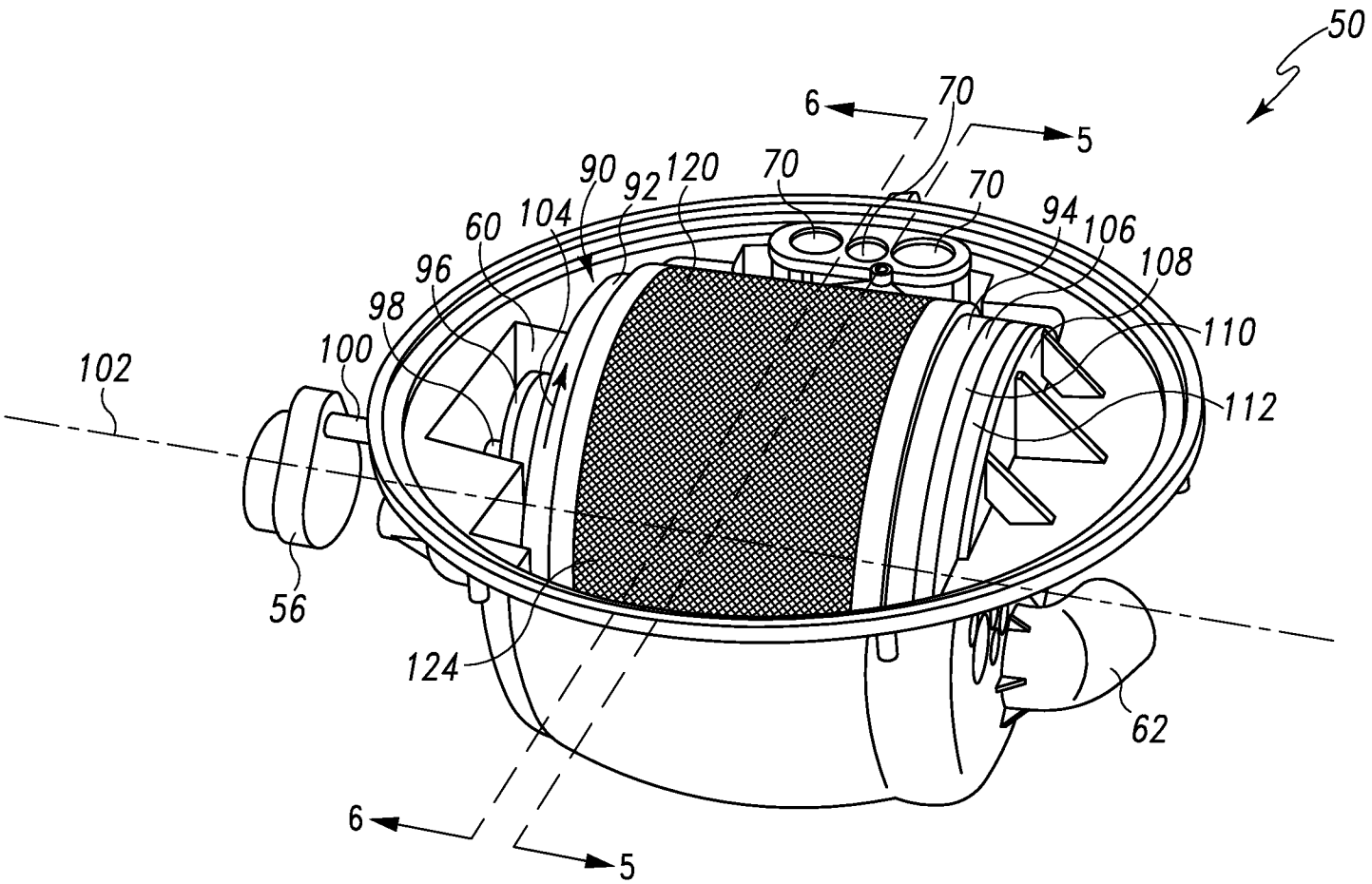
FIG. 4 is a perspective view of the embodiment of FIG. 3 showing the rotary drum filter and sump chamber with the filter cover removed.

As shown in FIG. 4, a rotary drum filter 90 extends into the sump chamber 60, and the cover 58 extends over the drum filter 90 to prevent fluid from falling directly onto the drum filter 90. The drum filter 90 includes a first end 92 and a second end 94. The first end 92 of the drum filter 90 is secured to a disk 96 having a shaft 98 extending therefrom. The shaft 98 is received in a drive shaft 100 coupled to the motor 56.

The motor 56 acts on the shafts 98, 100 to rotate the drum filter 90 about an imaginary axis 102. An arrow 104 indicates the direction of rotation of the drum filter 90. The imaginary axis 102 is positioned parallel with the bottom wall 42 of the tub 12. It should be appreciated that in other embodiments the dishwasher 10 may include belts, pulleys, gearing, etc. that connect the motor 56 to the drum filter 90. The motor 56 is connected to a power supply (not shown), which provides the electric current necessary for the motor 56 to spin the shafts 98, 100 and rotate the drum filter 90.

The second end 94 of the drum filter 90 contacts a bearing 106 positioned between the second end 94 of the drum filter 90 and an outlet sidewall 108 of the sump chamber 60. The bearing 106 creates a watertight connection between the drum filter 90 and the sidewall 108. In the illustrative embodiment, the bearing 106 includes a plastic seal 110 and a plastic seal 112. The seals 110, 112 have mating grooves (not shown) that fill with fluid to lubricate the seals 110, 112. It should be appreciated that in other embodiments the bearing 106 may be a one-piece component that creates the watertight connection between the drum filter 90 and chamber 60.

Figure 5:
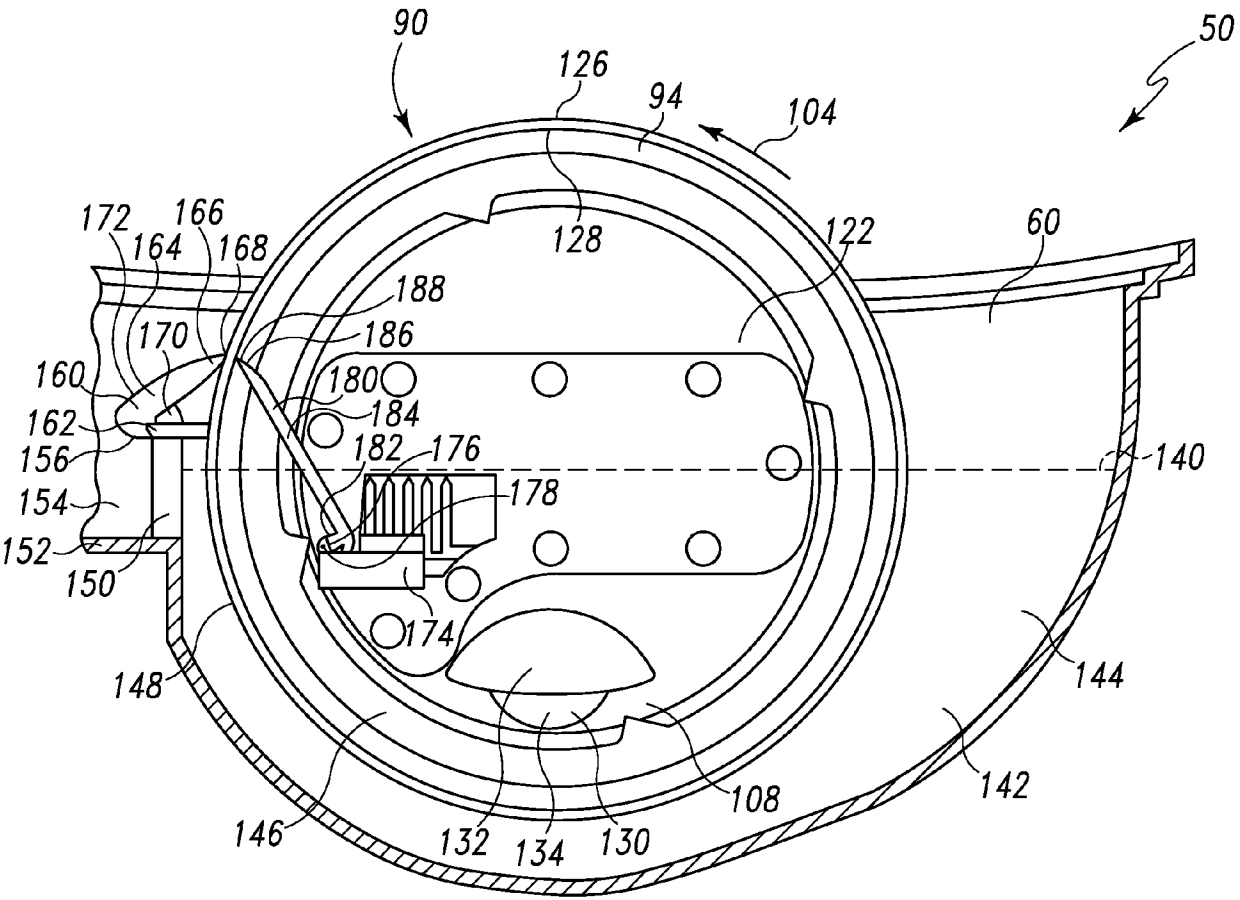
FIG. 5 is a cross-sectional elevation view of the embodiment of FIGS. 3 and 4 taken along the line 5-5 shown in FIG. 4.
Figure 6:
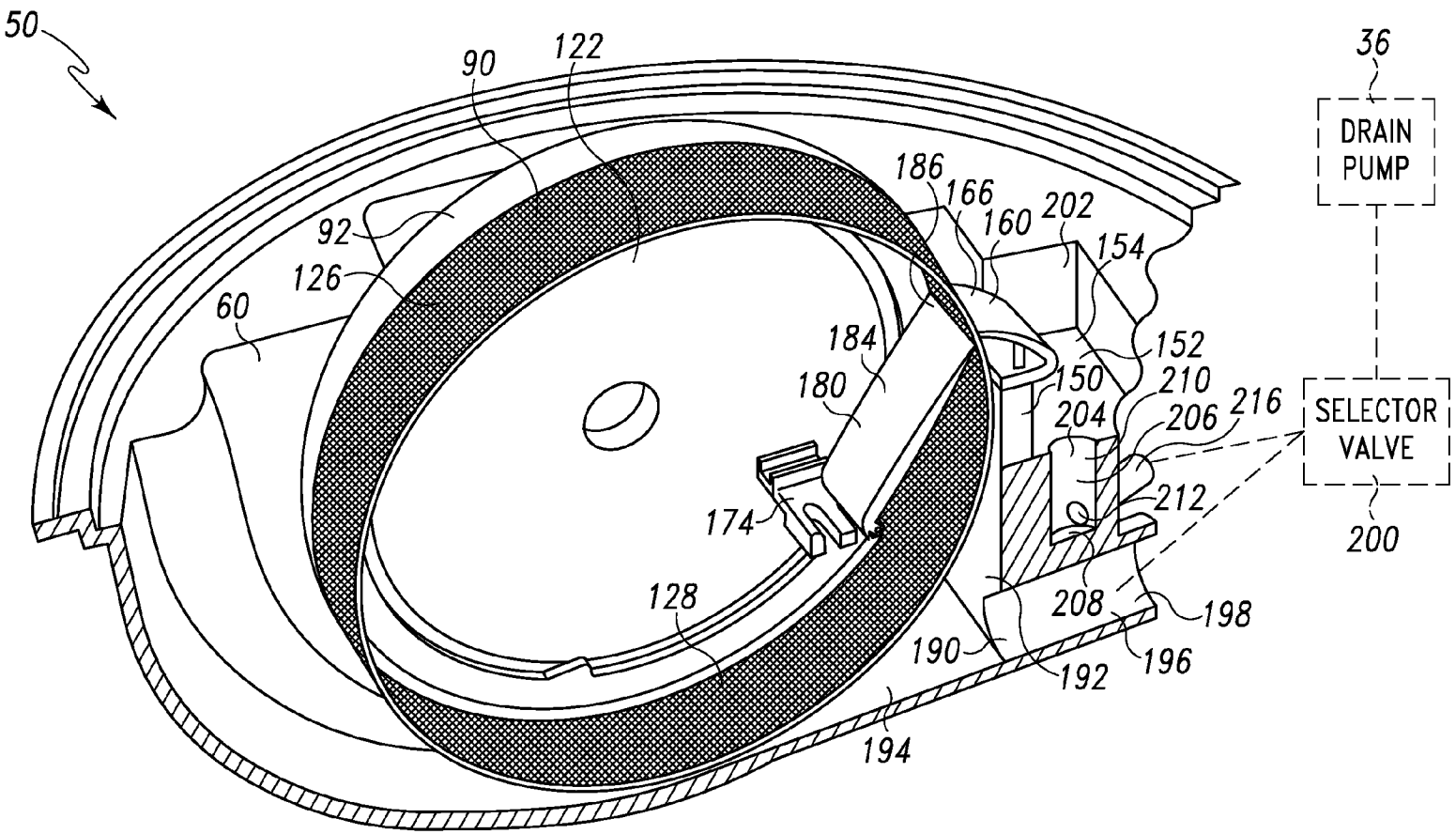
FIG. 6 is a cross-sectional perspective view of the embodiment of FIGS. 3-5 taken along the line 6-6 shown in FIG. 4.

A filter sheet 120 extends from the first end 92 to the second end 94 of the drum filter 90. The sheet 120 encloses a hollow interior 122 (see FIG. 5). The sheet 120 includes a number of holes 124, and each hole 124 extends from an outer surface 126 of the sheet 120 to an inner surface 128. Each hole 124 is sized to allow for the passage of wash fluid into the hollow interior 122 and prevent the passage of soil particles. In the illustrative embodiment, each hole 124 has an inner diameter of 0.150 to 0.300 millimeters. It should be appreciated that in other embodiments the holes may have a larger or smaller diameter. As shown in FIGS. 4-6, the sheet 120 is a sheet of perforated stainless steel. It should be appreciated that in other embodiments the sheet 120 may be embodied as chemically etched metal, woven wire mesh, or wedge wire formed from aluminum, stainless steel, polymer, or any other suitable filtering material.

Referring now to FIG. 5, a cross-sectional view of the recirculation sump 50 is shown. An outlet port 130 extends through the sidewall 108 of the sump chamber 60 to couple with the outlet tube 62. As described above in regard to FIG. 3, the outlet tube 62 is fluidly coupled to the wash pump 34. A cover 132 is positioned over the port 130 such that fluid is allowed to enter the port 130 through only a lower half 134 of the port 130.

An imaginary line 140 represents a typical fluid level in the sump chamber 60. The fluid level changes as the wash pump 34 moves fluid out of the sump chamber 60 through the port 130 and circulates fluid through the nozzles 54 of the spray arm 52. The filter sheet 120 divides the fluid in the sump chamber 60 into two parts. As wash fluid and removed soil particles collect in the sump chamber 60, a mixture 142 of fluid and soil particles forms in a region 144 external to the filter sheet 120. The holes 124 permit wash fluid to pass into the hollow interior 122, forming a volume of filtered wash fluid 146, while soil particles accumulate on the outer surface 126 of the sheet 120. The wash pump 34 moves the fluid 146 through the port 130 and recirculates it through the spray arm 52.

Only a portion 148 of the sheet 120 extends into the sump chamber 60 and into contact with fluid therein. As the drum filter 90 rotates in the direction indicated by the arrow 104, the portion 148 in contact with fluid continuously changes. In the illustrative embodiment, approximately sixty percent of the sheet 120 extends into the sump chamber 60. The percentage of the sheet 120 in contact with fluid may vary as the wash pump 34 circulates more or less fluid to the spray arm 52.

As shown in FIGS. 5 and 6, a soil chamber 154 is positioned adjacent to the sump chamber 60. A dividing wall 150 extending upwardly from a floor 152 separates the sump chamber 60 from soil chamber 154. A scraper 160 is secured to an upper surface 156 of the wall 150 via a mounting plate 162. An arm 164 extends at an angle from the mounting plate 162 and has a blade 166 formed at an end 168. The blade 166 is engaged with the outer surface 126 of the sheet 120 along the entire length of the sheet 120 from the first end 92 to the second end 94.

A spring 170 is positioned between the mounting plate 162 and the arm 164. The spring 170 exerts a spring bias on the arm 164 to keep the blade 166 engaged with the outer surface 126 of the sheet 120. It should be appreciated that other preloaded structures might be used in place of the spring 170 to keep the blade 166 engaged with the outer surface 126. As the drum filter 90 rotates, the blade 166 removes any soil particles that have accumulated on the outer surface 126. Removed soil particles move along an upper surface 172 of the scraper 160 and deposit in the soil chamber 154. While only a single scraper 160 is shown in contact with the outer surface 126, it should be appreciated that in other embodiments additional scrapers may be used to remove soil particles.

A second scraper 180 is positioned in the hollow interior 122 and is coupled to a beam 174. The beam 174 extends from the sidewall 108 into the hollow interior 122 and has a number of posts 176. A rod 178 extends through the posts 176 and a number of mounting legs 182 of the second scraper 180. In this way, the rod 178 secures the second scraper 180 to the beam 174.

An arm 184 extends from the mounting leg 182 of the scraper 180 and includes a blade 186 formed at an end 188. The blade 186 engages with the inner surface 128 of the sheet 120 along the entire length of the sheet 120 from the first end 92 to the second end 94. A coiled spring (not shown) extends over the rod 178 and exerts a spring bias on the arm 184 to keep the blade 186 engaged with the inner surface 128 of the sheet 120.

The passage of wash fluid through the holes 124 leaves a residual film on the inner surface 128 of the sheet 120. In the illustrated embodiment, the blade 186 removes the film from the inner surface 128 as the drum filter 90 is rotated. The removed film flows into filtered fluid 146 and is diluted or dissolved therein. It should be appreciated that while one scraper 180 is shown in contact with the inner surface 128, additional scrapers may be used to remove the film. It should also be appreciated that in other embodiments other mechanisms may be used to remove the film. For example, the dishwasher 10 might include a radiant heater that converts the film into a flaky, solid material, which is removed as the drum filter 90 is rotated.

Referring now to FIG. 6, the recirculation sump 50 is shown in a cross-section taken along the line 6-6 as shown in FIG. 4. A drain port 190 is positioned in a sidewall 192 near the bottom wall 194 of the sump chamber 60. A passageway 196 extends from the port 190 to an outlet 198. The outlet 198 is fluidly coupled to a selector valve 200. The selector valve 200 is operable to selectively connect the outlet 198 to the drain pump 36 such that fluid can be removed from the sump chamber 60.

The soil chamber 154 is also shown in greater detail in FIG. 6. A number of sidewalls 202 extend upwardly from the floor 152. The dividing wall 150, the sidewalls 202, and the floor 152 define the soil chamber 154. A drain port 204 is formed in the floor 152. A passageway 206 extends downwardly from the drain port 204 to a closed end 208. The passageway 206 has an inner surface 210 that includes an opening 212 formed near the closed end 208. A tube 216 extends outwardly from the opening 212 and has an outlet (not shown) that fluidly couples with the selector valve 200. In that way, the soil chamber 154 may be fluidly coupled with the drain pump 36. The selector valve 200 is operable to selectively connect the tube 216 to the drain pump 36 such that accumulated soil particles can be removed from the soil chamber 154.

During the operation of a wash cycle, wash fluid, such as water and/or wash chemistry (i.e., water and/or detergents, enzymes, surfactants, and other cleaning or conditioning chemistry), enters the tub 12 through the hole 48 defined in the sidewall 40 and flows into the sump chamber 60 of the recirculation sump 50. As the sump chamber 60 fills to the imaginary line 140, wash fluid passes through the holes 124 in the filter sheet 120 and into the hollow interior 122. After the sump chamber 60 is partially filled with fluid, the dishwasher 10 activates the wash pump 34, the diverter assembly 38, and the motor 56.

The operation of the wash pump 34 causes wash fluid to move out of the hollow interior 122 into the port 130. Wash fluid then passes through the diverter assembly 38, which selectively delivers wash fluid to spray arm 52 or any of the other spray arms positioned in tub 12. When wash fluid is delivered to the spray arm 52, it is expelled from the spray arm 52 onto any dishes or other wares positioned in the washing chamber 14. Wash fluid removes soil particles located on the dishwares, and the mixture of wash fluid and soil particles falls onto the bottom wall 42 of the tub 12. The sloped configuration of the bottom wall 42 directs that mixture into the sump chamber 60.

At the same time the wash pump 34 is moving wash fluid through the port 130, the motor 56 rotates the rotary drum filter 90 about the imaginary axis 102, continuously changing the portion 148 of the filter sheet 120 in contact with the fluid in the sump chamber 60. The wash pump 34 causes wash fluid to move through the holes 124 of the filter sheet 120 into the hollow interior 122. The passage of wash fluid through the sheet 120 leaves a residual film on the inner surface 128 of the sheet 120. In the illustrated embodiment, the rotation of the drum filter 90 causes the film to come into contact with the blade 186 of scraper 180. The blade 186 removes that film from the inner surface 128 as the inner surface 128 passes under the blade 186. The film is then dissolved or diluted in the fluid contained in the hollow interior 122.

As the outer surface 126 of the sheet 120 rotates out of the moving fluid, soil particles accumulate on the outer surface 126. The rotation of the drum filter 90 causes the accumulated soil particles to come into contact with blade 166 of scraper 160. The blade 166 removes the accumulated soil particles from the outer surface 126 as the outer surface 126 passes under the blade 166. The removed soil particles move along the upper surface 172 of the scraper 160 and deposit in the chamber 154.

At the conclusion of the wash cycle, the dishwasher 10 deactivates the wash pump 34 and the diverter assembly 38. When the wash pump 34 is deactivated, the fluid level rises above the dividing wall 150 such that fluid enters the soil chamber 154. The selector valve 200 connects the drain port 204 of the soil chamber 154 to the drain pump 36, and the dishwasher 10 engages the drain pump 36 to remove the fluid and soil particles from the soil chamber 154.

After an interval, the selector valve 200 connects the drain port 190 of the sump chamber 60 to the drain pump 36. The drain pump 36 moves the remaining fluid and soil particles out of the sump chamber 60 through the drain port 190.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A dishwashing machine, comprising:

a spray arm, a sump chamber positioned below the spray arm for collecting fluid and soil particles, a porous sheet enclosing a hollow interior and operable to rotate about an imaginary axis which extends substantially horizontal, a portion of the porous sheet extends into the sump chamber, an outlet positioned in a wall of the sump chamber and open to the hollow interior, a wash pump coupled to the outlet, wherein the wash pump is operable to recirculate fluid through the porous sheet into the hollow interior, and a scraper in contact with the porous sheet and configured to scrape soil particles from the porous sheet as the fluid is recirculated.

2. The dishwashing machine of claim 1, wherein the scraper includes an arm terminating in a blade which contacts the porous sheet.

3. The dishwashing machine of claim 1, wherein:

the porous sheet includes an outer surface and an inner surface, and the soil particles accumulate on the outer surface of the porous sheet when the fluid recirculated through the wash pump moves through the porous sheet into the hollow interior.

4. The dishwashing machine of claim 3, wherein the scraper includes a first scraper blade in contact with the outer surface of the porous sheet, the first scraper blade being operable to remove accumulated soil particles from the outer surface of the porous sheet.

5. The dishwashing machine of claim 4, further comprising:

a soil chamber positioned adjacent to the sump chamber, wherein the first scraper blade is positioned relative to the soil chamber such that soil particles removed by the first scraper blade accumulate in the soil chamber.

6. The dishwashing machine of claim 5, further comprising a drain pump coupled to the soil chamber and the sump chamber, wherein the drain pump is operable to remove accumulated soil particles from the soil chamber.

7. The dishwashing machine of claim 1, wherein the porous sheet includes a sheet selected from the group consisting of perforated metal, chemically etched metal, woven wire mesh, and wedge wire.

8. The dishwashing machine of claim 1, wherein the porous sheet is a sheet of perforated metal having a number of holes and each hole has a diameter of 0.150 to 0.300 millimeters.

9. The dishwashing machine of claim 1, wherein the portion of the porous sheet that extends into the sump chamber is less than or equal to approximately sixty percent of the porous sheet.

10. The dishwashing machine of claim 1, wherein the outlet is directly exposed to the hollow interior such that the fluid flows through the porous sheet, into the hollow interior and then into the outlet when recirculated by the wash pump.

11. The dishwashing machine of claim 1, further comprising:

a soil chamber positioned adjacent to the sump chamber for accumulating said soil particles, and a drain pump operable to remove the soil particles from the soil chamber.

12. A dishwashing machine comprising:

a spray arm, a sump chamber positioned below the spray arm for collecting fluid and soil particles, a porous sheet enclosing a hollow interior and operable to rotate about an imaginary axis, a portion of the porous sheet extends into the sump chamber, the porous sheet includes an outer surface and an inner surface, an outlet positioned in a wall of the sump chamber and within the hollow interior, a wash pump coupled to the outlet, wherein the wash pump is operable to move fluid through the porous sheet into the hollow interior and soil particles accumulate on the outer surface of the porous sheet when fluid moves through the porous sheet into the hollow interior, and a scraper in contact with the outer surface of the porous sheet, wherein the scraper includes a first scraper blade in contact with the outer surface of the porous sheet and operable to remove accumulated soil particles from the outer surface of the porous sheet and a second scraper blade in contact with the inner surface of the porous sheet.

13. The dishwashing machine of claim 12, wherein the imaginary axis extends substantially horizontal.

14. The dishwashing machine of claim 12, further comprising:

a soil chamber positioned adjacent to the sump chamber, wherein the first scraper blade is positioned relative to the soil chamber such that soil particles removed by the first scraper blade accumulate in the soil chamber.

15. The dishwashing machine of claim 14, further comprising a drain pump coupled to the soil chamber and the sump chamber, wherein the drain pump is operable to remove accumulated soil particles from the soil chamber.

16. A dishwashing machine, comprising:

a washing chamber having a bottom surface, a sump chamber positioned in the bottom surface of the washing chamber, a cylindrical drum operable to rotate about an imaginary axis parallel to the bottom surface of the washing chamber, the drum having a first end, a second end, and a portion of the drum extending into the sump chamber, a filter sheet extending from the first end of the drum to the second end of the drum and enclosing a hollow interior, the filter sheet having an outer porous surface and an inner porous surface, a first scraper blade in contact with the outer porous surface, and a second scraper blade in contact with the inner porous surface.

17. The dishwashing machine of claim 16, wherein the first scraper blade extends from the first end of the drum to the second end of the drum.

18. The dishwashing machine of claim 16, further comprising:

a motor positioned relative to the sump chamber, the motor having a shaft operable to rotate about the imaginary axis, wherein the first end of the drum is coupled to the shaft such that the motor is operable to rotate the drum about the imaginary axis.

19. The dishwashing machine of claim 18, further comprising:

a beam positioned in the hollow interior, wherein the second scraper blade is coupled to a portion of the beam.

* * * * *